US005993281A

United States Patent [19]

Musket

[11] Patent Number: 5,993,281

[45] Date of Patent: Nov. 30, 1999

[54] SHARPENING OF FIELD EMITTER TIPS USING HIGH-ENERGY IONS

[75] Inventor: Ronald G. Musket, Danville, Calif.

[73] Assignee: The Regents of the University of California, Oakland, Calif.

[21] Appl. No.: 08/872,031

[22] Filed: Jun. 10, 1997

[51] Int. Cl.[6] ..... H01J 9/02

[52] U.S. Cl. ..... 445/50

[58] Field of Search ..... 445/24, 50; 204/192.34

[56] References Cited

U.S. PATENT DOCUMENTS

| | | | |
|---|---|---|---|
| 4,968,382 | 11/1990 | Jacobson et al. | 445/24 |
| 5,727,978 | 3/1998 | Alvis et al. | 445/50 |
| 5,836,799 | 11/1998 | Levine et al. | 445/50 X |

OTHER PUBLICATIONS

M. Takai et al., "Modification of Field Emitter Array (FEA) Tip Shape by Focused Ion Beam Irradiation", International Vacuum Microelectronics Conference, Abstracts, pp. 52–55 (1995).

O. Auciello et al., "Ion Bombardment Sharpening of Field Emitter Arrays", International Vacuum Microelectronics Conference, Abstracts, pp. 192–196 (1995).

*Primary Examiner*—Kenneth J. Ramsey
*Attorney, Agent, or Firm*—L. E. Carnahan

[57] ABSTRACT

A process for sharpening arrays of field emitter tips of field emission cathodes, such as found in field-emission, flat-panel video displays. The process uses sputtering by high-energy (more than 30 keV) ions incident along or near the longitudinal axis of the field emitter to sharpen the emitter with a taper from the tip or top of the emitter down to the shank of the emitter. The process is particularly applicable to sharpening tips of emitters having cylindrical or similar (e.g., pyramidal) symmetry. The process will sharpen tips down to radii of less than 12 nm with an included angle of about 20 degrees. Because the ions are incident along or near the longitudinal axis of each emitter, the tips of gated arrays can be sharpened by high-energy ion beams rastered over the arrays using standard ion implantation equipment. While the process is particularly applicable for sharpening of arrays of field emitters in field-emission flat-panel displays, it can be effectively utilized in the fabrication of other vacuum micro-electronic devices that rely on field emission of electrons.

17 Claims, 2 Drawing Sheets

SHARPENING OF FIELD EMITTER TIPS USING HIGH-ENERGY IONS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to fabrication of field emitters, particularly to sharpening of field emitter tips, and more particularly to sharpening the tips using high-energy ions incident along or near the longitudinal axis of the field emitter.

In field emission flat-panel displays, the emitted current for a certain applied gate voltage is strongly influenced by the sharpness of the emitter tip. This is a consequence of the electric field enhancement that results from decreasing tip radius or sharpness and the shape of the shank of the emitter below the tip. The effect is present independent of the nature of the tip structure (e.g., cones, filaments, pyramids, or wires). As the dimensions of the emitters and associated elements (e.g., gate diameters) decreases, sharpening of the emitter tips becomes more difficult and, usually, is not performed. However, increasing the sharpness of the tips reduces the gate voltage required for a given emission current and, consequently, the required power. The power required to operate the emission part of the flat panel display is the product of the capacitance and the square of the gate voltage; thus, there is significant incentive to decrease the gate voltage.

Various prior efforts have been directed to sharpening the field emitter tips. Previous attempts to sharpen such tips using ions were limited to low-energy ions (e.g., less than 10 keV) or to focused ion beams. These low-energy ion and focused ion approaches are respectively exemplified by O. Auciello et al., "Ion Bombardment Sharpening of Field Emitter Arrays", International Vacuum Microelectronics Conference, Abstracts, p. 192–196 (1995); and M. Takai et al., "Modification of Field Emitter Array (FEA) Tip Shape by Focused Ion Beam Irradiation", International Vacuum Microelectronics Conference, Abstracts, p. 52–55 (1995). Low-energy ions provide some sharpening, but the sharpness is limited by lower sputtering yields (i.e., number of atomic ejections per ion) and to the region near the top of the tip and does not modify the shape of the tip sufficiently to maximize the field enhancement factor. The use of focused ion beams is constrained by the diameter of the focused ion beam and is a serial sharpening process, which is not an acceptable manufacturing option because of the large number of emitters required (i.e., more than 500 emitters per pixel).

Recently, efforts have been directed to fabricating field emitters with sharp emitting points, wherein the metal emitters are formed by electroplating, and the shape of the formed emitter is controlled by the potential imposed on the gate as well as on a separate counter electrode. Such a process is described and claimed in copending U.S. application Ser. No. 08/847,086, filed May 1, 1997, entitled "Electrochemical Formation of Field Emitters", assigned to the same assignee. Also, sharpening of previously formed field emitter tips has been carried out, wherein tip sharpening is done by electroetching/polishing using the grid (gate) of the field emission structure, such as a field emission triode structure, as a counter electrode. Such a process is described and claimed in copending U.S. application Ser. No. 08/847,087 filed May 1, 1997 entitled "Electrochemical Sharpening of Field Emission Tips", assigned to the same assignee.

The present invention provides a more efficient process for sharpening field emitter tips and is adaptable to manufacturing operations for fabricating tips of gated arrays. This is accomplished by using high-energy (30 keV or more) ion beams rastered over the arrays using standard ion implantation equipment. The high-energy ion are incident along or near the longitudinal axis of the field emitters to sharpen the tips with a taper from a sharp point down to the shank of the emitter. The process will sharpen tips down to radii of less that 12 nm with an included angle of about 20 degrees. Also, the process can be utilized to shorten the length of the field emitter after the tip has been sharpened.

SUMMARY OF THE INVENTION

It is an object of the present invention to provide sharpening of field emitter tips.

A further object of the invention is to provide sharpening of field emitter tips using high-energy ions.

Another object of the invention is to provide a process for sharpening field emitter tips using sputtering by 30 keV or higher energy ion beams incident along or near the longitudinal axis of the field emitter.

Another object of the invention is to provide a process using a high-energy ion beam to sharpen field emitter tips with a taper from the end down to the shank of the emitter.

Another object of the invention is to provided a process that will sharpen emitter tips down to a radii of less than 12 nm with an included angle of about 20 degrees.

Another object of the invention is to provide a field emitter sharpening process that can be readily incorporated into the manufacturing operation for producing gated arrays, such as utilized in field-emission flat-panel video displays.

Other objects and advantages of the process of the present invention will become apparent from the following description and accompanying drawings. Basically, the invention involves sharpening field emitter tips using high-energy ions. By directing a beam of ions having an energy of at least 30 keV incident along or near the longitudinal axis of the field emitter the emitter is tapered from the tip, or top end point, down to the shank of the emitter, with an included angle of about 20 degrees. The process can be used to sharpen tips of emitters having radii down to less than 12 nm. Because the ions are incident along or near the longitudinal axis of each tip, tips in gated arrays can be sharpened by the high-energy beams being rastered over the arrays using standard ion implantation equipment. Once a steady state in the shape of the tip is achieved, continued application of the ion beam will shorten the emitter without further sharpening of the tip. Thus the desired height position of the tip in the gated device can be uniformly produced. While the process of the invention has specific application to sharpening arrays of field emitter tips in field-emission flat-panel displays, it can be effectively utilized in the manufacture of other microelectronic devices that rely on field emission of electrons.

BRIEF DESCRIPTION OF THE DRAWINGS

The accompanying drawings, which are incorporated into and form a part of the disclosure, illustrate embodiments of the process of the invention and, together with the description, serve to explain the principles of the invention.

DETAILED DESCRIPTION OF THE INVENTION

The present invention is directed to sharpening of field emitter tips using high-energy ions. By sharpening the emitter tips of a gated device the gate voltage is reduced and the required power to operate the gated device is reduced. The present invention involves a process that uses sputtering by high-energy (30 keV and higher) ions incident along or near the longitudinal axis of the field emitter to sharpen the tip with a taper from the point, or top end, down the shank of the emitter. The process is applicable to all emitter tips having cylindrical, or similar (e.g., pyramidal), symmetry. The process will sharpen tips down to radii of less than 12 nm with an included angle $\theta_i$ of about 20 degrees, see FIG. 1. Because the ions are incident along or near the longitudinal axis of each tip, tips of both ungated and gated arrays can be sharpened by high-energy ion beams rastered over the arrays using standard ion implantation equipment.

Because the process consists of irradiating tips of field emitters with high-energy ions incident along or near the axis of the emitters, and these ions remove atoms of the tip by sputtering, with preferential removal occurring from the outer surfaces of the tip due to the higher yield for forward sputtering. Thus, the sides (i.e., shank) of the tip are eroded faster than the top of the tip until the included angle $\theta_i$ approaches about 20 degrees. Then a steady state in the shape is achieved leading to no further sharpening, but just shortening of the emitter. Because the best emitter performance occurs when the top of the tip is within the gate structure, see FIG. 3, excessive shortening should be avoided by halting the sharpening process, see FIG. 2, when the included angle reaches about 15–25 degrees, see FIG. 1, depending on the material of the tip. For tips inside gated structures, a masking layer (over the gate material), see FIG. 2, may be required to preclude ion bombardment damage of the inter-metal dielectric layers by the high-energy ions. For nano-cone emitter configurations deposited using the Spindt process, it may be possible to perform the irradiations with the pinch-off coating in place and acting as the masking layer.

Figure 2:
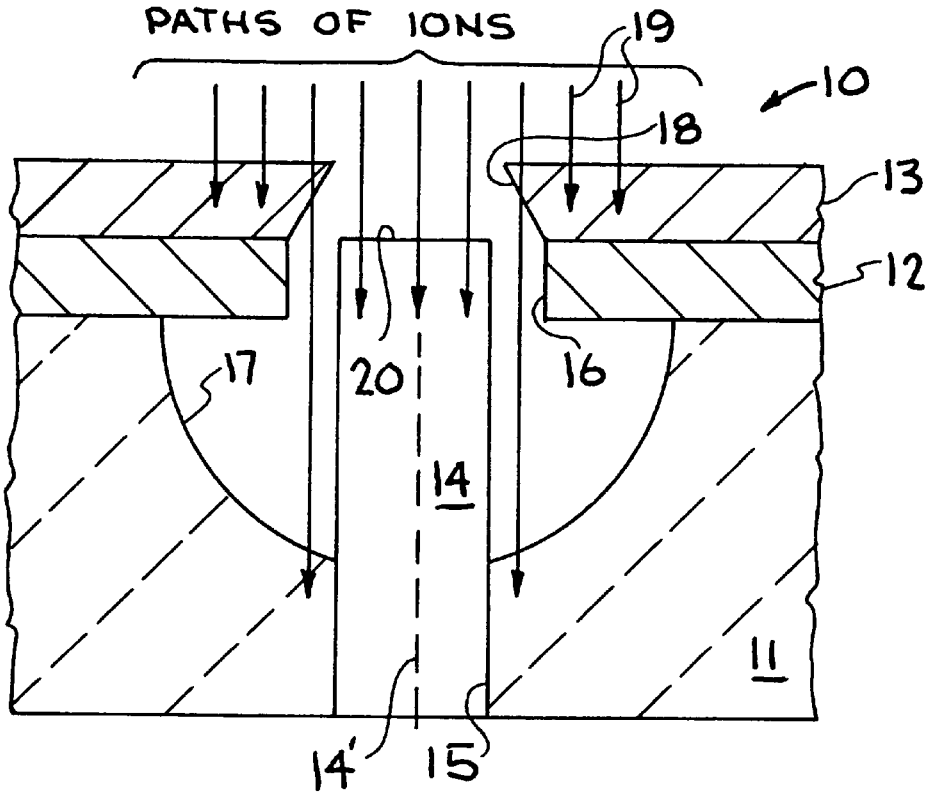
FIG. 2 illustrates in partial cross-section a gated emitter structure at the start of high-energy ion tip sharpening.

Referring now to FIG. 2 which illustrates schematically the process for a nanofilament emitter in a gated structure with a masking layer, the structure generally indicated at 10 comprises a dielectric layer 11 (typically formed on a substrate, not shown), a gate metal or electrode layer 12, a masking layer 13, and an emitter 14 extending through a via 15 in the dielectric layer 11 and a via 16 in the gate metal layer 12, with the dielectric layer 11 having a cavity 17 around a section of the emitter 14. The masking layer 13 is provided with a tapering via 18 extending from the via 16 to a point aligned with the longitudinal outer surface of the emitter 14. A beam of high-energy ions (30 keV or greater) from a source not shown, are directed along paths indicated by arrows 19 onto the top 20 of emitter 14 and onto masking layer 13. As shown, the path 19 of ions is incident along the longitudinal axis 14' of the emitter 14 and thus strike only the top 20 of the emitter 14, with the masking layer 13 preventing the ions from striking the gate metal layer 12 and decreasing the energy of ions passing through the tapered surface forming via 19 and around the emitter 14 which strike the dielectric layer 11.

Figure 3:
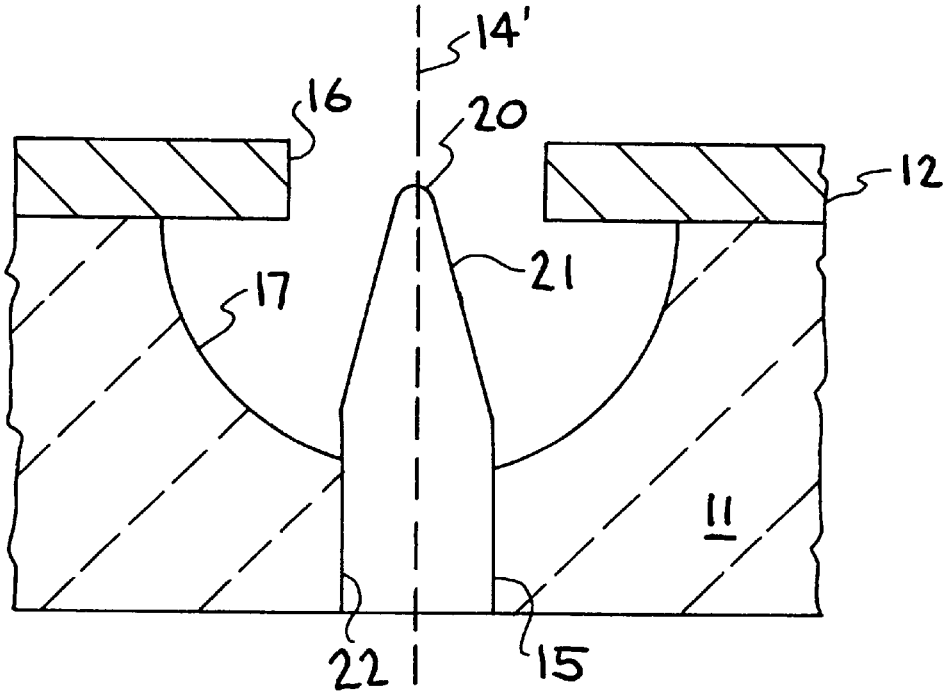
FIG. 3 illustrates in partial cross-section the gated emitter structure of FIG. 2 with a sharpened emitter tip carried out by high-energy ion sharpening.

As shown in FIG. 3, the ions 19 bombard the emitter 14 so as to sharpen the tip 21 such that it tapers from the top 20 to the shank 22 of the emitter. Also, by comparing the height of emitter 14 in FIG. 3 with that of FIG. 2, the emitter has also been shortened to a desired point in via 16 in gate metal layer 12 and the tip 21 is centrally located in via 16. The masking layer 13 has been removed, as shown in FIG. 3, by conventional techniques, but for certain applications the layer 13 may be retained.

Figure 1:
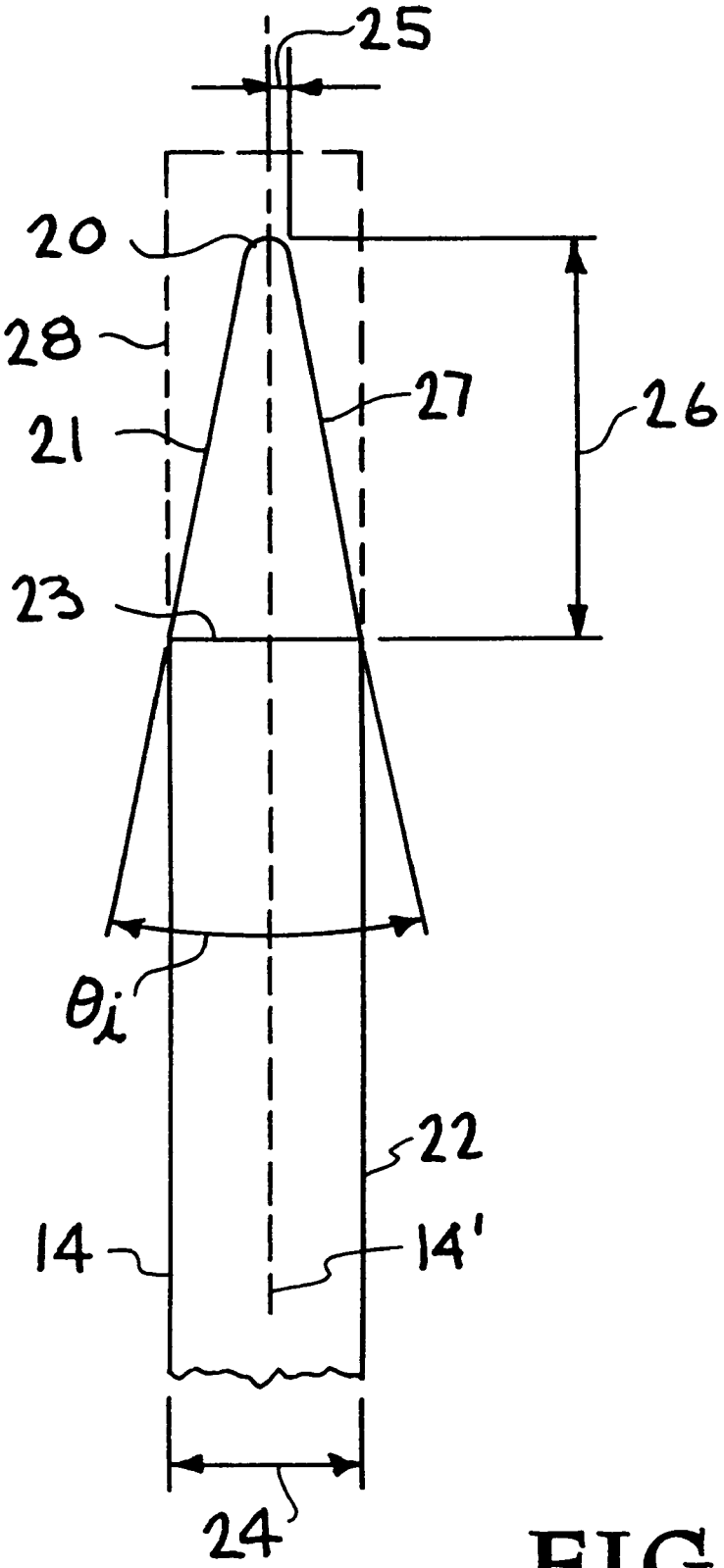
FIG. 1 illustrates a geometry of a sharpened field emitter tip on a cylindrical post in accordance with the present invention.

The distance between the top 20 of tip 21 and the base 23 of tip 21 above the shank 22, indicated by arrow 26, see FIG. 1, is determined mainly by the range of the ions in the material of tip 21 and the sputtering rate of the material of emitter 14. Applying the process to ungated nickel (Ni) nanofilaments resulted in data of the before and after produced by scanning electron micrographs, not shown. The initial diameter 24 and height of the cylindrical nanofilaments, one being illustrated by the dashed line 28 in FIG. 1, were about 65 nm and 770 nm, respectively. After irradiation with 100 keV Argon ions incident along the longitudinal axis of the nanofilaments to a dose of $6\times10^{16}$ Ar/cm$^2$, the diameter of the base 23 of tip 21 of the nanofilament was unchanged. The change was in the area of tip 21, wherein the radius, indicated by arrow 25, of the top 20 of tip 21 was about 12 nm and the filament height was about 700 nm, a reduction of about 70 nm. The distance between the tip top 20 and the tip base 23 (top to shank), indicated by arrow 26, was about 115 nm. The taper 27 of tip 21 is at the included angle $\theta_i$, was about 20 degrees as indicated by the dash lines as seen in FIG. 1. The high-energy ions may range from 30 keV to about 300 keV, and the radius of the tip top may range from 5 to 30 nm.

It has thus been shown that the present invention provides a process for shaping field emitter tips using high-energy ions. The ion beam is directed such that the ions are incident along or near the longitudinal axis of the emitters and will sharpen tips down to a radii of less that 12 nm with an included angle of about 20 degrees. Because the ions are incident along the longitudinal axis of the emitter, tips of gated arrays can be sharpened by high-energy ion beams rastered over the gated arrays. Sharpening of the emitter tips reduces the gate voltage and thus reduces the power required to operate the device.

While a particular embodiment for carrying out the process has been illustrated and or described and particular parameters and materials have been set forth to exemplify and teach the principles of the invention, such are not intended to be limiting. Modifications and changes may become apparent to those skilled in the art, and it is intended that the invention be limited only by the scope of the appended claims.

What is claimed is:

1. A process for sharpening field emitter tips, comprising:

directing a beam of ions onto the field emitter such that the ions are incident along or near the longitudinal axis of the field emitter, and forming the beam of ions so as to have an energy greater than 30 keV wherein sharpening of the tips is carried out to define an included angle of about 20 degrees.

2. The process of claim 1, wherein the ion beam energy is in the range of from greater than 30 keV to about 300 keV.

3. The process of claim 1, additionally including forming the field emitter tips in a gated device, and directing the beam of ions onto the field emitters for a time period sufficient to sharpen and shorten the emitters such that the sharpened tips are located centrally in via of the gated device.

4. The process of claim 1, additionally including shortening the field emitters, following sharpening the tips of the emitter, using the beam of ions.

5. The process of claim 1, wherein sharpening of the tips is carried out to define a tip radius of about 5–30 nm.

6. The process of claim 1, additionally including rastering the beam of ions over the field emitter tips.

7. In a process for fabricating a device having a gated structure in which at least one field emitter is located, the improvement comprising:

sharpening the tip of the at least one field emitter by directing greater than 30 keV ions incident along or near the longitudinal axis of the at least one field emitter; and shortening the at least one field emitter by continuing the directing of the ions onto the at least one field emitter after sharpening to an included angle of about 20 degrees.

8. The improvement of claim 7, wherein the ions are directed onto the at least one field emitter such that a tip having a radius in the range of 5 to 30 nm is formed.

9. The improvement of claim 7, additionally providing the ions with an energy in the range of greater than 30 keV to about 300 keV.

10. The process of claim 7, additionally including forming the gated structure to include at least a dielectric layer, a gate material layer, and a mask layer, forming at least one aligned via in each of the layers, and forming a field emitter in at least the via of the dielectric and gate material layers, then sharpening the tip of the field emitter.

11. The process of claim 10, additionally including forming the via in the mask layer to having an opening corresponding to a top surface of the field emitter.

12. The process of claim 10, wherein the sharpening is carried out so as to locate the sharpened tip in the center of the via in the gate material layer.

13. The process of claim 12, wherein the ions are directed onto the tip of the field emitter so as to shorten the field emitter such that it does not extend beyond the via in the gate material layer.

14. In a process for sharpening field emitter tips using a beam of ions, the improvement comprising:

forming the beam of ions to have an energy of greater than 30 keV, and directing the beam of ions onto the field emitter until an include angle of about 20° is formed on the tip.

15. The improvement of claim 14, wherein the energy of the beam of ions range from greater than 30 keV to about 300 keV.

16. The improvement of claim 14, wherein the ions are directed so as to be incident along or near the longitudinal axis of the field emitter.

17. The improvement of claim 16, wherein the beam of ions is directed onto the field emitter for a period of time sufficient to produce an emitter tip with a radius of 5 to 30 nm.

* * * * *